United States Patent [19]

Adler et al.

[11] 4,252,066

[45] Feb. 24, 1981

[54] LEVERED HOPPER DOOR LOCK MECHANISM

[75] Inventors: Franklin P. Adler, Michigan City, Ind.; Rudolph E. Nadherny, Naperville, Ill.

[73] Assignee: Illinois Railway Equipment Company, Chicago, Ill.

[21] Appl. No.: 906,841

[22] Filed: May 17, 1978

[51] Int. Cl.[3] ..... B61D 49/06; E05B 65/14

[52] U.S. Cl. ..... 105/248; 105/280; 105/308 R; 105/308 P

[58] Field of Search ..... 105/308 R, 308 P, 248, 105/280

[56] References Cited

U.S. PATENT DOCUMENTS

| | | | |
|---|---|---|---|
| 1,867,789 | 7/1932 | Wine et al. | 105/308 R |
| 3,240,165 | 3/1966 | Floehr | 105/308 R |
| 4,184,432 | 1/1980 | Allen | 105/248 |

*Primary Examiner*—Richard A. Bertsch

*Attorney, Agent, or Firm*—Lockwood, Dewey, Alex & Cummings

[57] ABSTRACT

A lever operated lock mechanism for a hopper door is provided which is especially suitable for use on railway hopper cars having hinged double doors. Included in the lock mechanism is a hook assembly which is pivotally mounted on a housing secured to the door frame or slope sheet of the hopper. A keeper assembly is attached to the spreader bar joining the double doors for engaging the hook assembly, this engagement being at either of two saddle formations or notches, the first or catch saddle formation being engaged when the lock mechanism is in a catch position, and the second or closed saddle formation being engaged when the lock mechanism is in a fully closed position. Movement between the catch position and the fully closed position is greatly facilitated by fulcrum means for receiving a lever bar by which a workman can readily close the hopper doors. Pivotally mounted to the mechanism is a locking latch for abutting engagement between the housing and the hook assembly to thereby wedgingly lock the lock mechanism in its fully closed position.

20 Claims, 15 Drawing Figures

FIG. 11
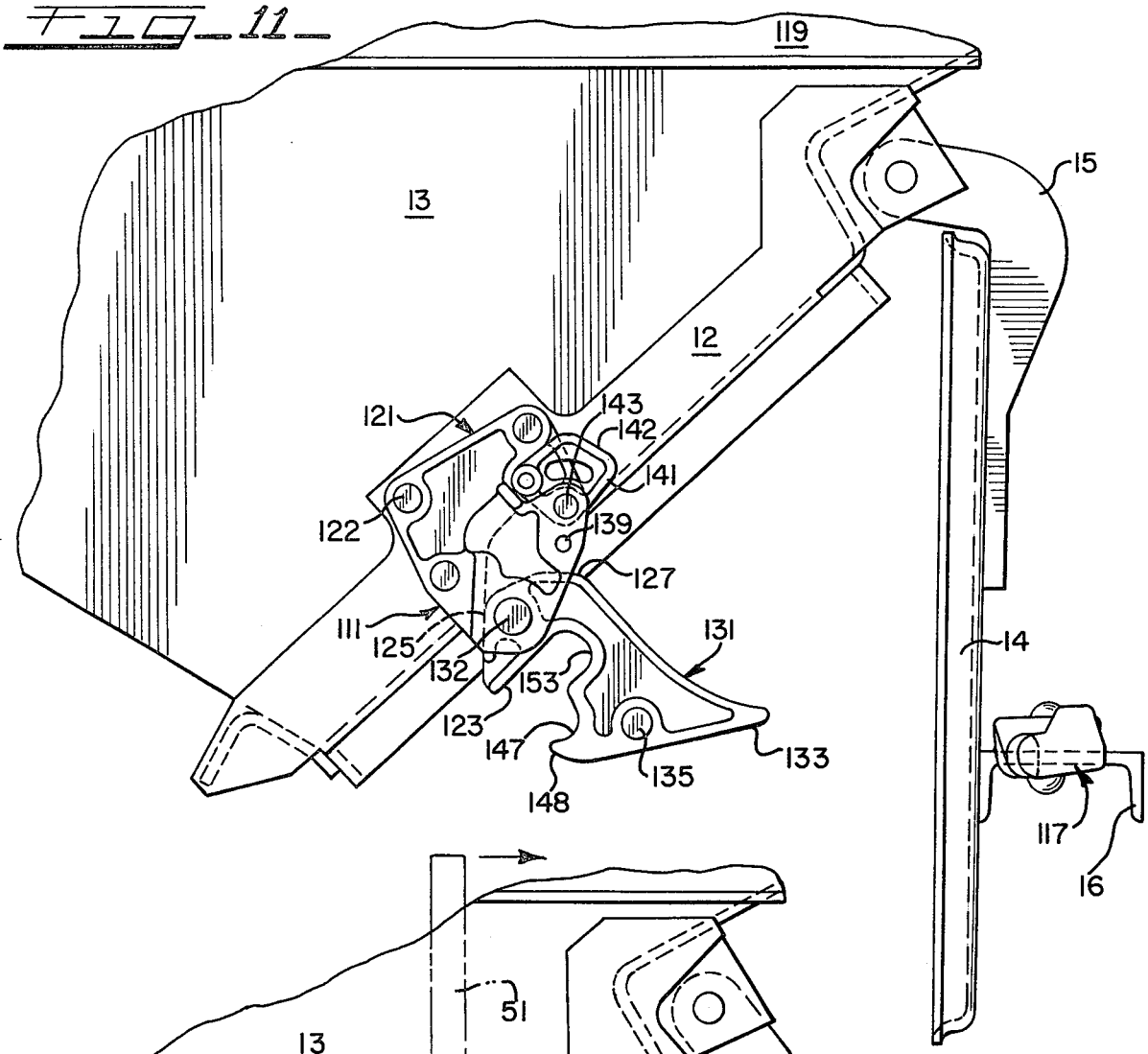
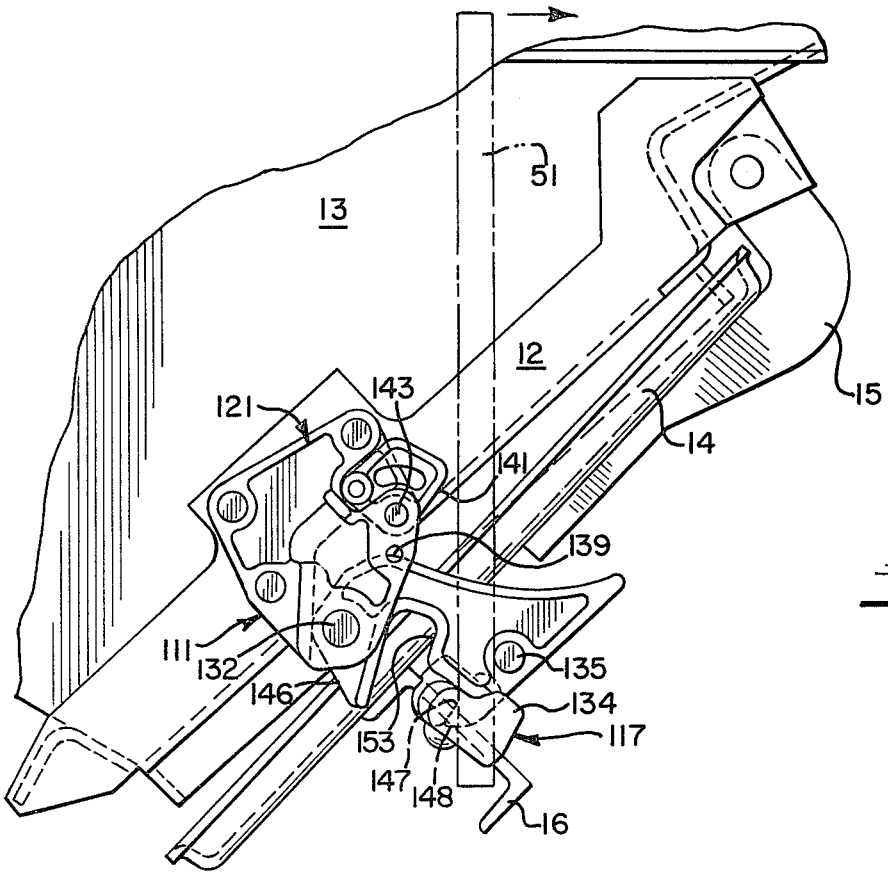
FIG. 12

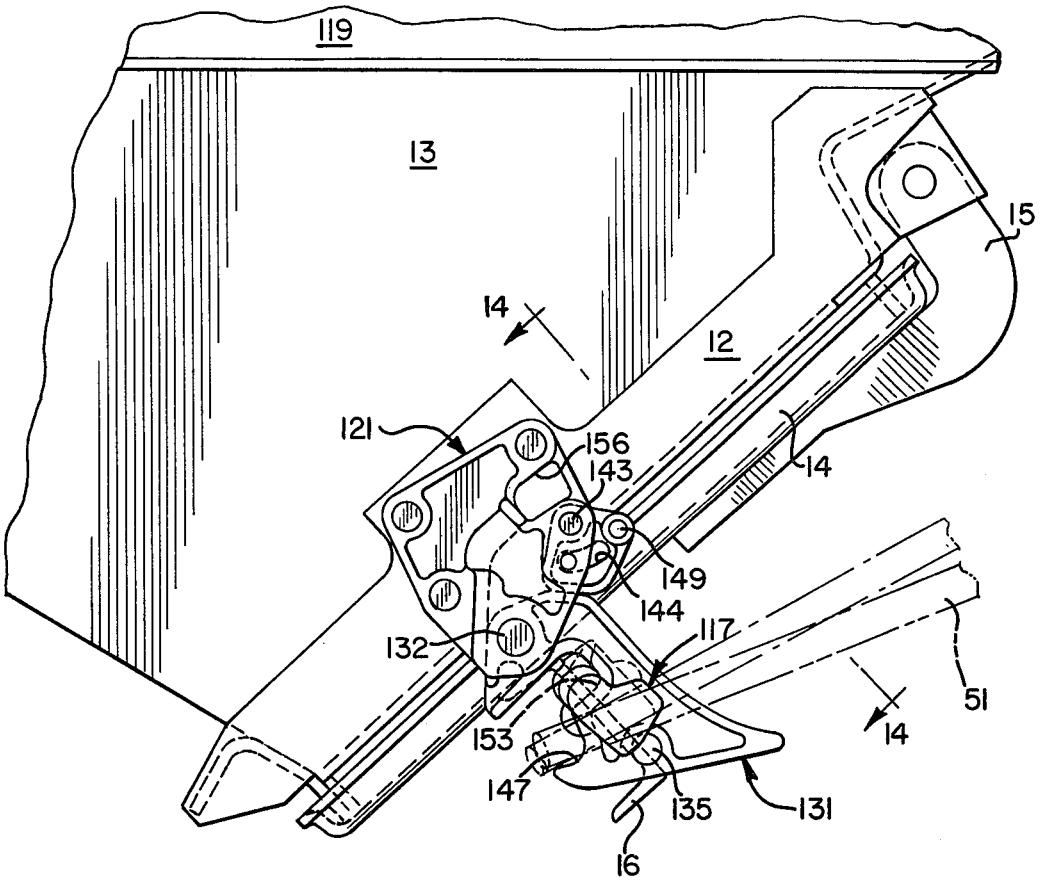
FIG. 13
FIG. 14
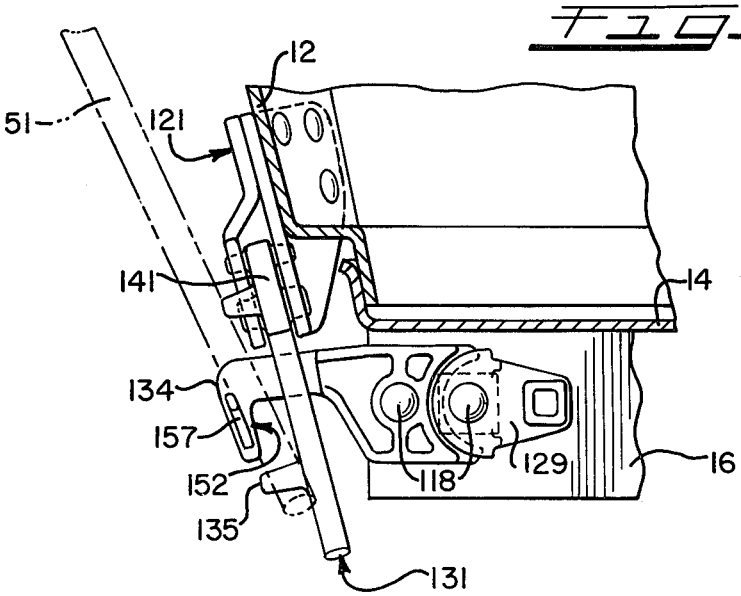

142
144
149
141
143
156
121
138
145
139
154
155
126
145
126
127
131
132
153
135
146
147
118
129
123
148
118
134
16
117
157

LEVERED HOPPER DOOR LOCK MECHANISM

BACKGROUND AND DESCRIPTION OF THE INVENTION

The present invention generally relates to a lock mechanism for a hopper door, more particularly to improved, lever operated lock mechanisms which are mounted on both sides of railway hopper cars for closing, locking and opening adjacent double doors simultaneously.

Generally, railway hopper cars are constructed to be emptied through a plurality of adjacent double doors located on the underside of the car whereby the bulk of the contents within the hopper car may be discharged therefrom through said doors and into a collecting area located below the railway tracks. Usually, one of the double doors is accessible from the opposite side. Often, a spreader bar is added for joining adjacent double hopper doors to ensure that neither one of the doors will open until lock mechanisms provided on both of the outside hopper sheets are unlocked.

Previously well-known double door lock mechanisms include a pivotable hook that is actually a double hook in that it has one small recess which engages the rim of a bowl-shaped spreader extension to hold the doors in the "catch" position and one larger recess to permit the hook to drop into the spreader extension bowl and the door to move to a fully closed position. Two workmen generally work together from opposite sides of the hopper cars and swing the open adjacent double doors from the fully opened position to the "catch" position by pushing with one foot on the spreader bar extensions. In the "catch" position, the doors are open a few inches at their bottoms. Each man next places a long pry bar or lever bar, usually about 5 feet long and $1\frac{1}{4}$ inch in diameter, through a hole in a loop mounted on the door and into the spreader extension bowl. By pulling on the lever bar, each workman moves the spreader extension until the hook drops into the spreader extension bowl; and, if the lock mechanism is properly adjusted, the doors will then be fully closed. If the hook does not drop to the fully closed position, the workman hammers it there by using one end of his pry bar. Next, the workman moves a locking cam to the lock position and hammers it to the fully locked position with a hammer or an end of the pry bar. This type of locking cam arrangement has been found to fail on occasion when the entire hopper car is rotated for unloading.

To unlock this well-known type of prior art double door lock, a workman hammers the locking cam to the unlocked position and then pounds the hook upwards to release the door. Sometimes the hook stays up momentarily, permitting the door to move to the fully opened position. At other times, the hook drops in time to hold the door in the "catch" position, in which case, the workman hammers the hook upwards to release the door. The hook is operated primarily by gravity, making the operation thereof somewhat dependent upon the particular orientation of the hopper car and the freedom with which the hook pivots about its pivot pin.

Copending Adler U.S. Ser. No. 849,755, now U.S. Pat. No. 4,184,432, improves upon this known construction by providing a single-recess hook member that is both pivotable and slidable such that it pivots to properly locate the door as it moves from the fully opened position to the "catch" position or vice versa, while it also slides for movement between the "catch" position and the fully closed position.

The present invention, while being a significant and useful improvement over the previously well-known lock, operates in an over-all manner that is somewhat similar to it but more easily and more reliably used. The lock mechanism of this invention is less expensive than the lock mechanism of said copending Adler application and makes possible the application of leverage more directly upon the hopper door, thereby avoiding the need to hammer portions of the locking mechanism into place.

It is, therefore, a general object of the present invention to provide an improved levered hopper door lock mechanism.

Another object of the present invention is to provide an improved levered double door lock mechanism for double doors of a railway hopper car.

Another object of the present invention is to provide an improved double door hopper lock mechanism that applies leverage directly on the portions thereof that are most closely associated with the opening and closing operations.

Another object of this invention is an improved railway hopper door lock mechanism that operates in an over-all manner that is familiar to workers in the art, but more easily and reliably than the present widely-used and well-known locking device.

Another object of the present invention is an improved lever operated lock mechanism for use on double doors of hopper railway cars having members able to align with each other through holes in each whereby a locking bolt can be installed to semi-permanently lock the mechanism in its fully closed position.

These and other objects of the present invention will be apparent from the following detailed description of a preferred embodiment, taken in conjunction with the accompanying drawings wherein:

FIG. 11 is a side elevational view of the preferred embodiment of the levered lock mechanism of this invention, shown mounted on an outside hopper door frame of a railway hopper car;

FIG. 12 is a side elevational view of the lock mechanism of FIG. 11, shown with the door in its catch position and with a lever bar in position to move the door from its catch position to its fully closed position;

FIG. 13 is a side elevational view of the lock mechanism of FIG. 11, showing the door after it has been levered into its fully closed position by a lever bar illustrated therein and locked and bolted by means of a locking latch;

FIG. 14 is a detail sectional view taken on line 14—14 of FIG. 13; and

These detailed embodiments of the invention are now discussed from which it can be seen that a workman will operate each in a general manner common to all of the embodiments, which includes levering the lock mechanism from its catch position to its fully closed position, the levering force imparting a downward force component on the keeper assembly in order to push and lever the lock mechanism from operative interengagement at the first saddle formation or notch to operative interengagement at the second saddle formation or notch.

Figure 1:
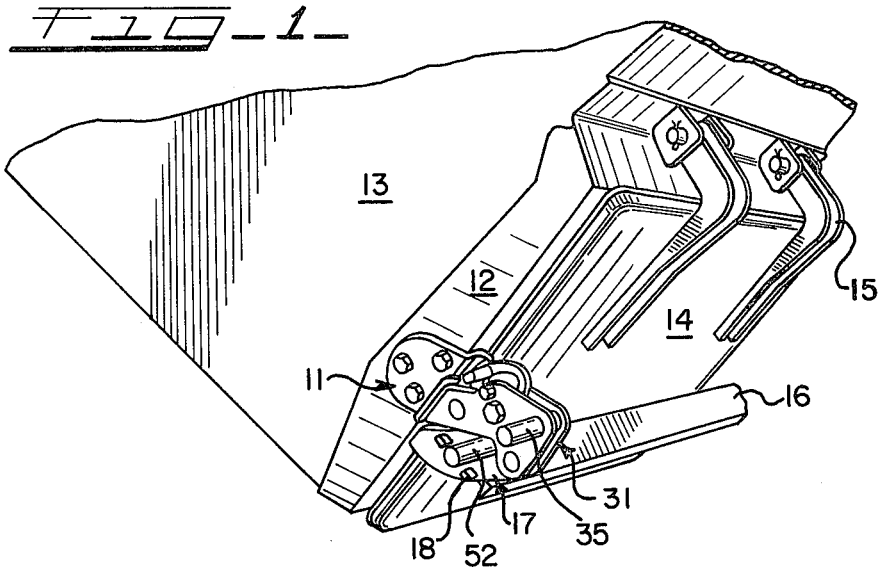
FIG. 1 is a perspective view of a particular embodiment of the levered lock mechanism of this invention, shown mounted on an outside hopper door frame of a railway hopper car.

FIG. 1 shows an embodiment of a lever operated lock mechanism, generally referred to by reference numeral 11, mounted on the hopper door frame 12 along an outside hopper sheet 13 of a conventional railway car hopper having a door 14, pivotally mounted by means of hinges 15. A spreader bar 16, which is typically a rolled z-bar or a rolled channel, interconnects door 14 with its adjacent door (not shown). Usually, another lever operated lock mechanism 11 will be mounted on the opposing outside hopper sheet of the hopper so that each lock mechanism 11 is accessible from its respective side of the railway car. A keeper assembly 17 is securely mounted, such as by welding, to each end of spreader bar 16. Height locators 18 typically will be provided for facilitating securement of each keeper assembly 17 to the spreader bar 16. Keeper assembly 17 operatively interconnects with the rest of the lock mechanism 11 to locate the door 14 in either its catch or its locked position.

Figure 6:
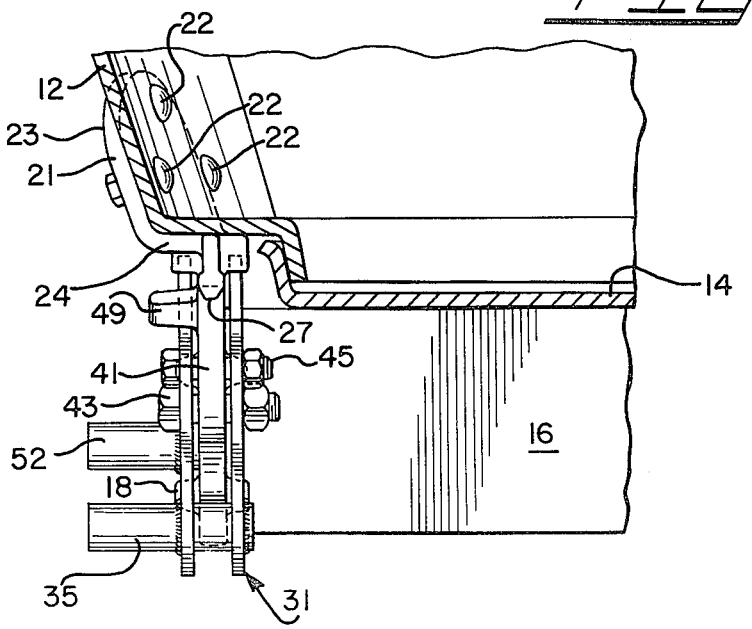
FIG. 6 is a detail sectional view taken on line 6—6 of FIG. 5.
Figure 7:
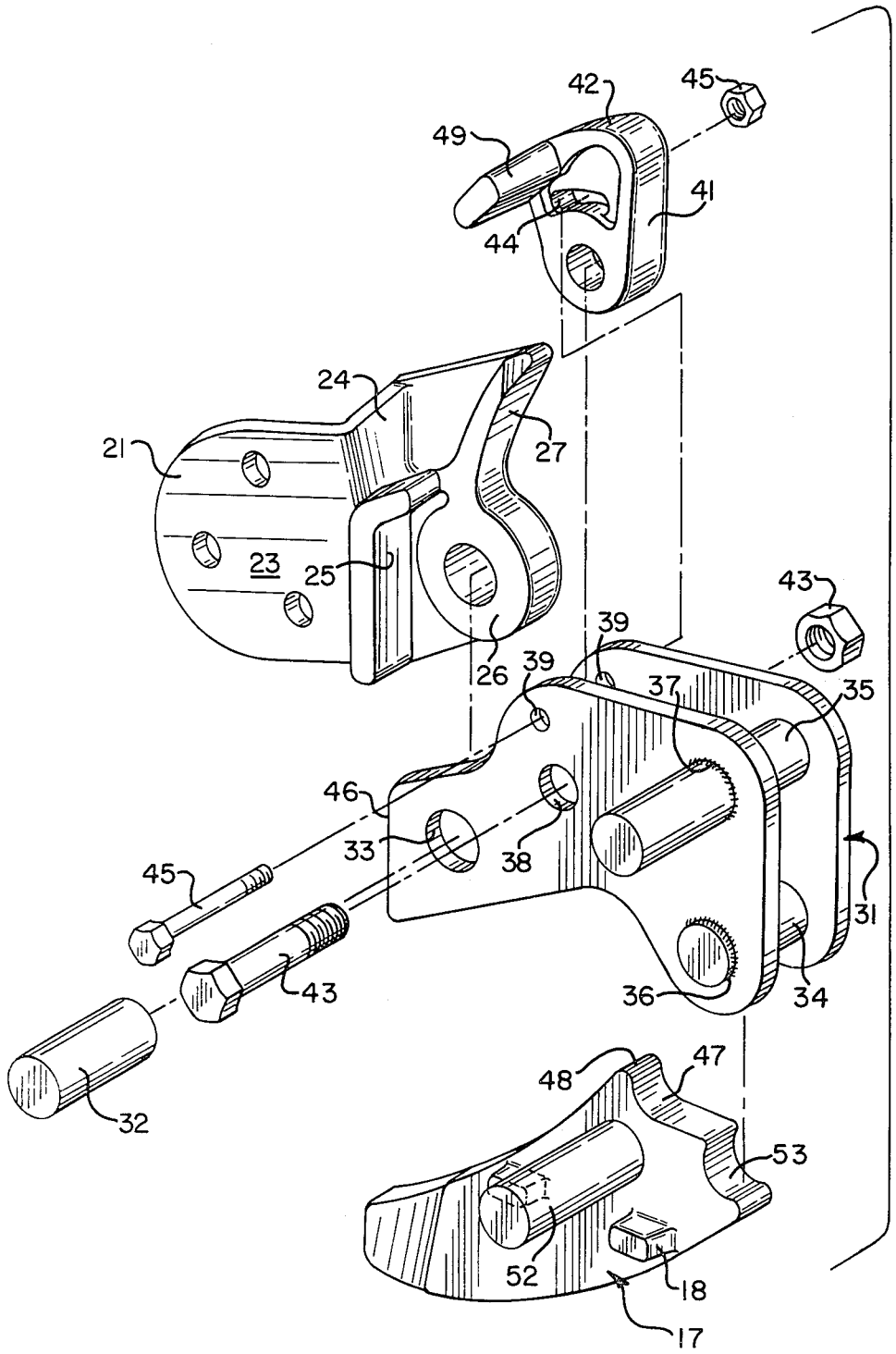
FIG. 7 is an exploded perspective view of the lock mechanism of FIG. 1.

The details of this particular lever operated lock mechanism 11 can be readily understood from FIGS. 2–6, showing the three operating positions desired of the doors 14 of a railway hopper car. Mechanism 11 includes a housing 21 secured to the door frame 12, usually by means of nuts and bolts 22 or the like. Housing 21 overlies a corner of the door frame 12 by having a lateral portion 23 and a generally transverse portion 24 (FIG. 6). A stop ledge 25, which can generally be considered as forming part of the transverse portion 24, is located behind an apertured lug 26 which protrudes from said transverse portion 24. An abutment edge 27 projects above the apertured lug 26 (FIG. 7).

A hook assembly 31 is pivotally mounted to housing 21 by means of a pivot rod 32 passing through each of two pivot rod holes 33 and said apertured lug 26. Hook assembly 31 is a bifurcated member joined by a locking rod 34 and a lever rod 35. Typically, locking rod 34 will pass through locking rod holes 36 and be securely fastened therein, such as by welding or the like. In a similar fashion, lever rod 35 passes through and is securely mounted at lever rod holes 37. Lever rod 35 protrudes laterally well beyond the outside one of the lever rod holes 37. Hook assembly 31 also includes a pair of locking latch pivot holes 38 and a pair of opposing bolt holes 39.

Pivotally mounted to the hook assembly through the locking latch pivot holes 38 is a locking latch 41 having a curved abutment face 42 for contacting the curved edge 27 of the housing 21 when the door 14 is in its fully closed position. The locking latch 41 is mounted to the hook assembly 31 by means of a pivot member 43 which can be a nut and bolt or the like. A curved slot 44 is located within the locking latch 41 in general alignment with bolt holes 39 so that a nut and bolt assembly 45 (FIG. 5) can be passed therethrough to lock the mechanism 11 and hence the door 14 in a semi-permanent manner if desired, such as when the hopper car will be rotated upside down during use. Locking latch 41 has a lug 49 for grasping and rotating the latch 41.

Figure 2:
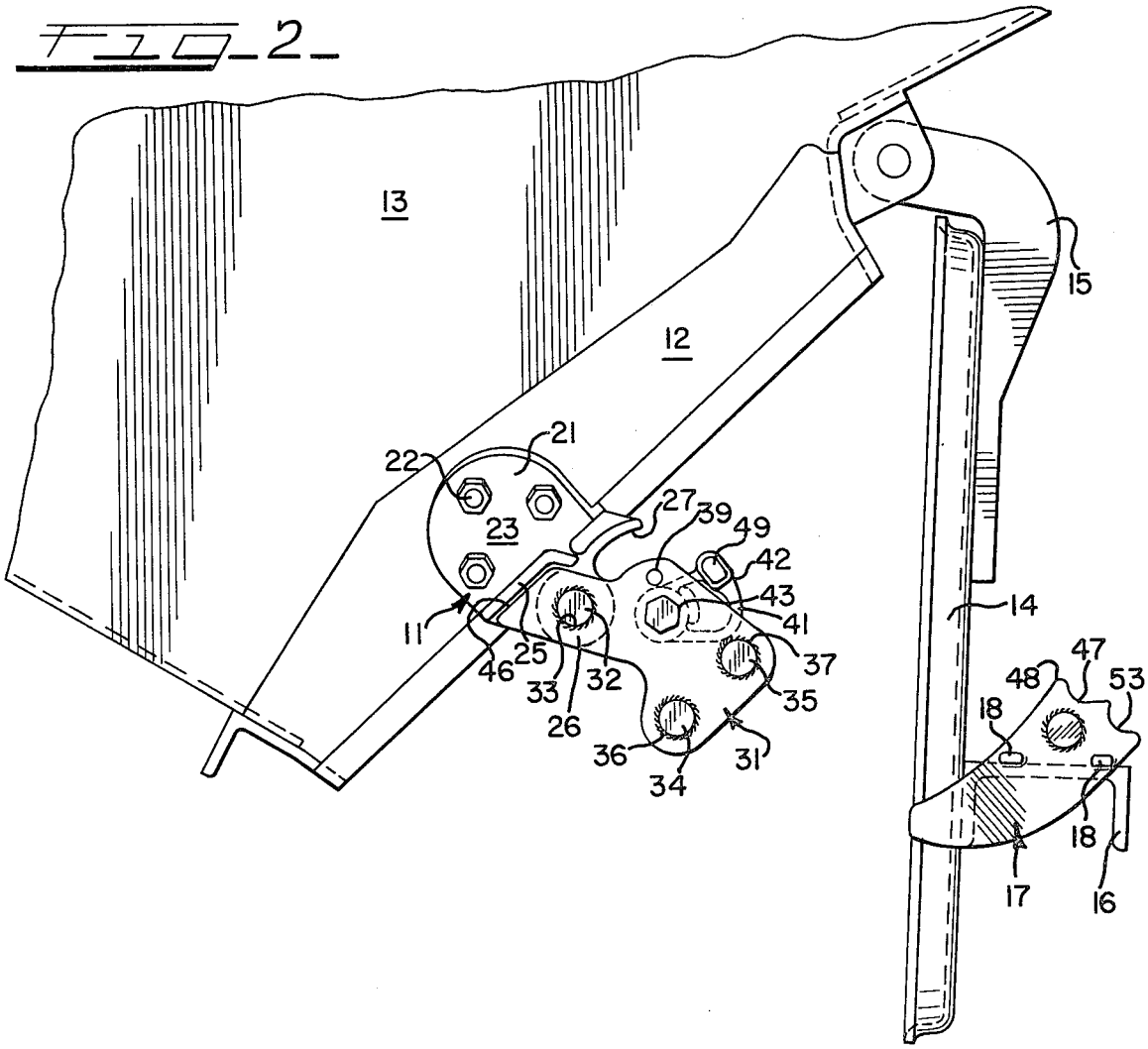
FIG. 2 is an enlarged side elevational view of the lock mechanism of FIG. 1, shown with the door in its fully opened position.

When door 14 is in its fully opened position as shown in FIG. 2, the hook assembly 31 is completely disengaged from the keeper assembly 17 mounted on the spreader bar 16 of the door 14. Also, one end 46 of the hook assembly 31 generally abuts against the stop ledge 25 of the housing 21, such abutting contact defining the limit of clockwise rotation or pivoting of the hook assembly 31. Generally, the locking latch 41 also will be at its clockwise rotation limit, typically resting upon the lever rod 35.

Figure 3:
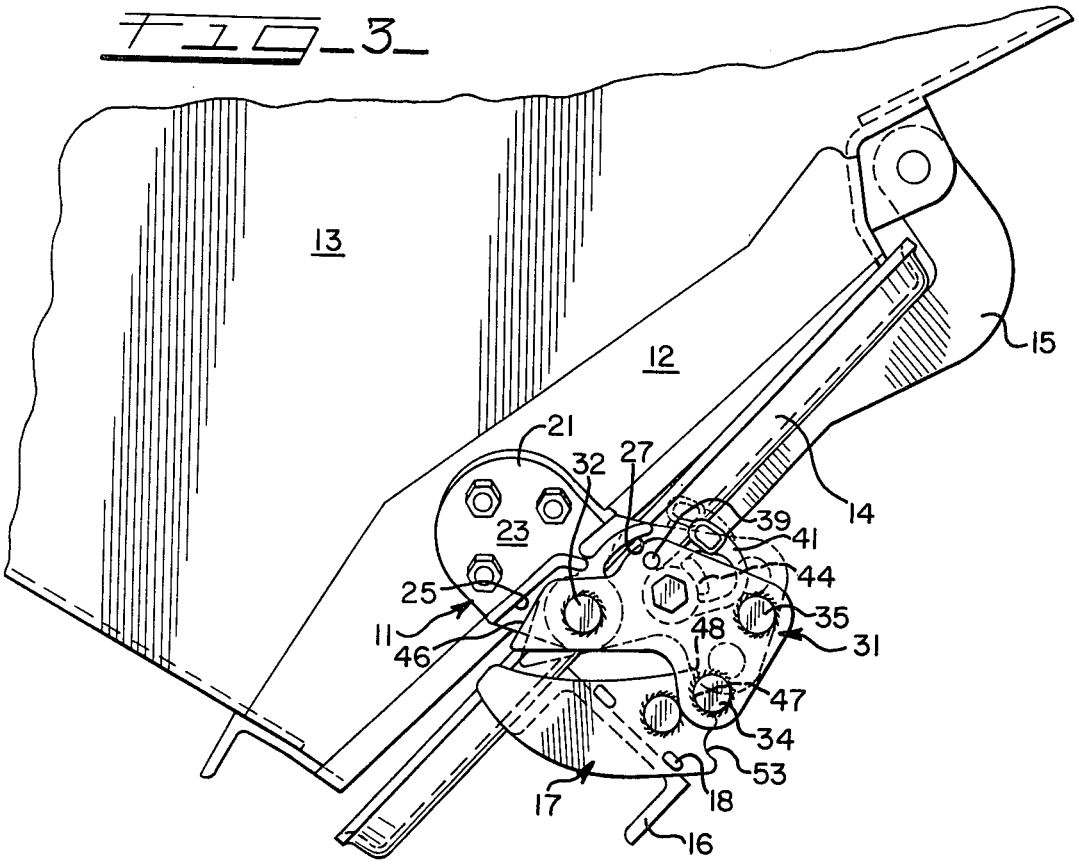
FIG. 3 is a side elevational view similar to FIG. 2 of the lock mechanism of FIG. 1, shown with the door in its catch position.

FIG. 3 illustrates the catch position of the lock mechanism 11, at which time the locking rod 34 rests within a first or catch saddle formation 47 of said keeper assembly 17. In moving the hopper door 14 from the fully opened position shown in FIG. 2 to the catch position shown in FIG. 3, a workman on each side of the hopper car pushes the door 14 toward its closed position until the locking rod 34 initially engages the keeper assembly 17 at upper corner 48. By continuing to push the door 14, the hook assembly 31 will move counterclockwise until the locking rod 34 clears the upper corner 48, at which time the hook assembly 31 will pivot clockwise and fall into the first saddle formation 47 to operatively engage the hook assembly with the keeper assembly and locate the door 14 in its catch position.

Figure 4:
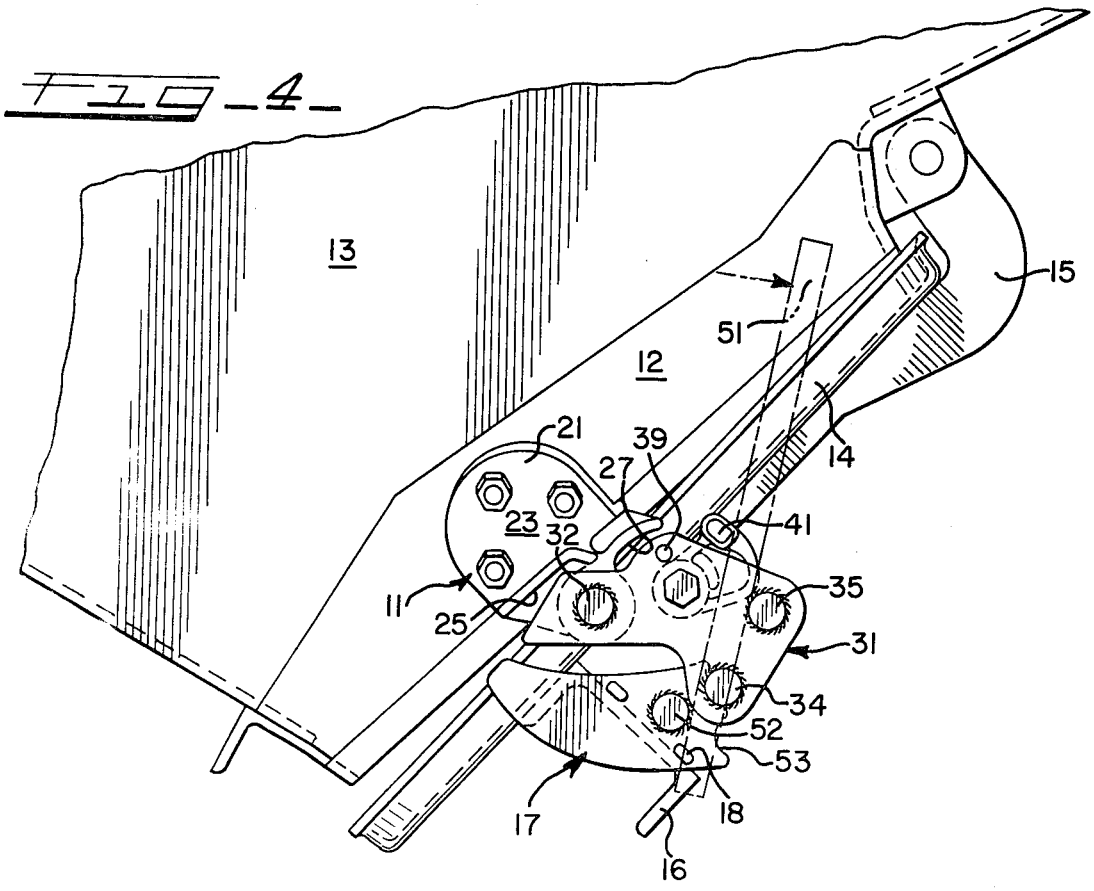
FIG. 4 is a side elevational view similar to FIG. 2 of the lock mechanism of FIG. 1, showing a lever bar in position to move the door from its catch position to its fully closed position.
Figure 5:
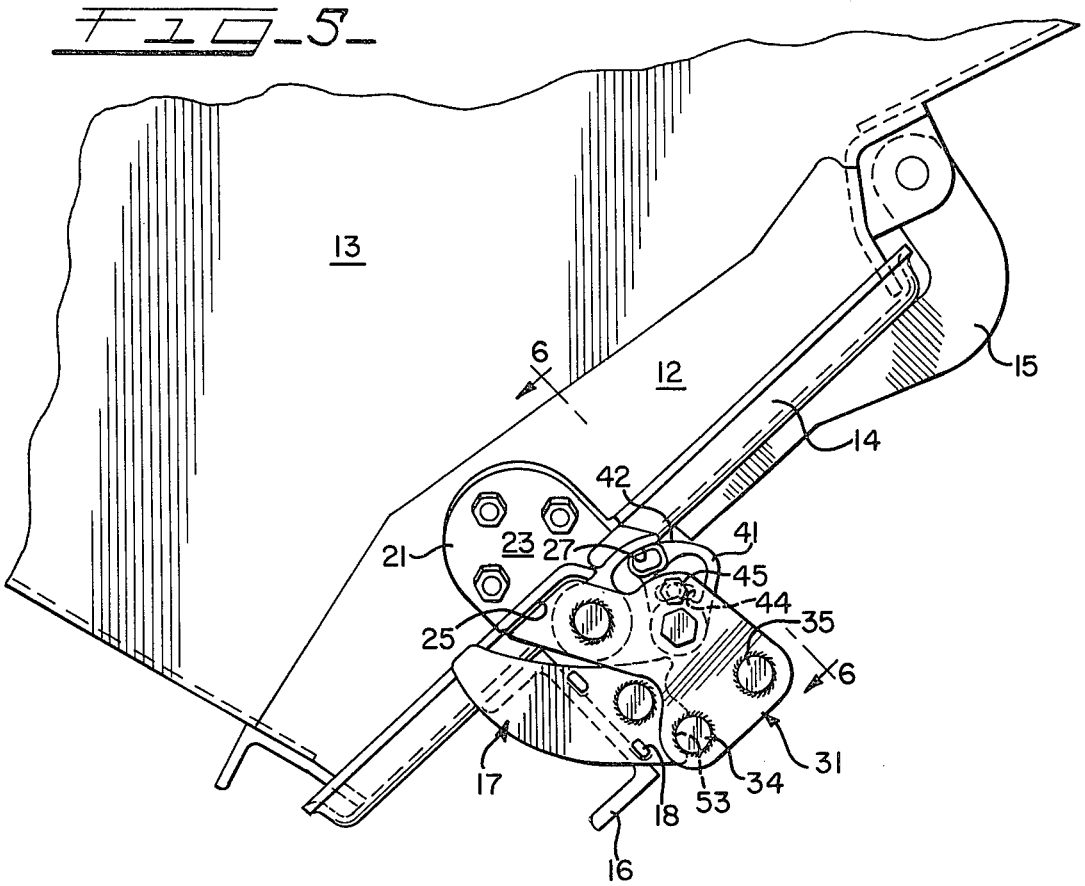
FIG. 5 is a side elevational view similar to FIG. 2 of the lock mechanism of FIG. 1, showing the door in its fully closed position.

Once the lock mechanism 11 is in the catch position, the workman may proceed to fully close the door 14, which step is depicted in FIG. 4. A pry or lever bar 51 is inserted into the fulcrum means of the lock mechanism 11. In this particular embodiment the fulcrum means is a combination of the lever rod 35 of the hook assembly 31 and a keeper rod 52 projecting laterally from said keeper assembly 17. Next, the workman pulls or pushes the lever bar 51 in a generally clockwise direction to thereby exert a force directly on keeper assembly 17 and rod 35. As a first stage of closing, the door 14 is moved to its closed position as the locking rod 34 passes from the first saddle formation 47 and into a second or closed saddle formation 53. Then, in a second stage of closing, the lever bar 51 exerts a generally downward force upon lever rod 35 to thereby move the hook assembly 31 down fully into the second saddle formation 53 for moving the lock mechanism 11 to its fully closed position, illustrated in FIGS. 5 and 6.

The workman may then rotate the locking latch 41 in a counterclockwise direction until the curved abutment face 42 thereof firmly engages the curved edge 27 of said housing 21. At this location, the bolt holes 39 of the hook assembly 31 are in general alignment with the curved slot 44 of the locking latch 41 so that the nut and bolt assembly 45 may be passed therethrough and tightened to semi-permanently lock the lock mechanism 11 in its fully closed position.

The exploded perspective view of FIG. 7 most clearly shows the structure of the various assembly parts of this particular lock mechanism 11, including the keeper assembly 17 and its rod 52, the housing 21, the hook assembly 31 with its lever rod 35, the pivot rod 32, the locking latch 41, and the pivot member 43.

Figure 8:
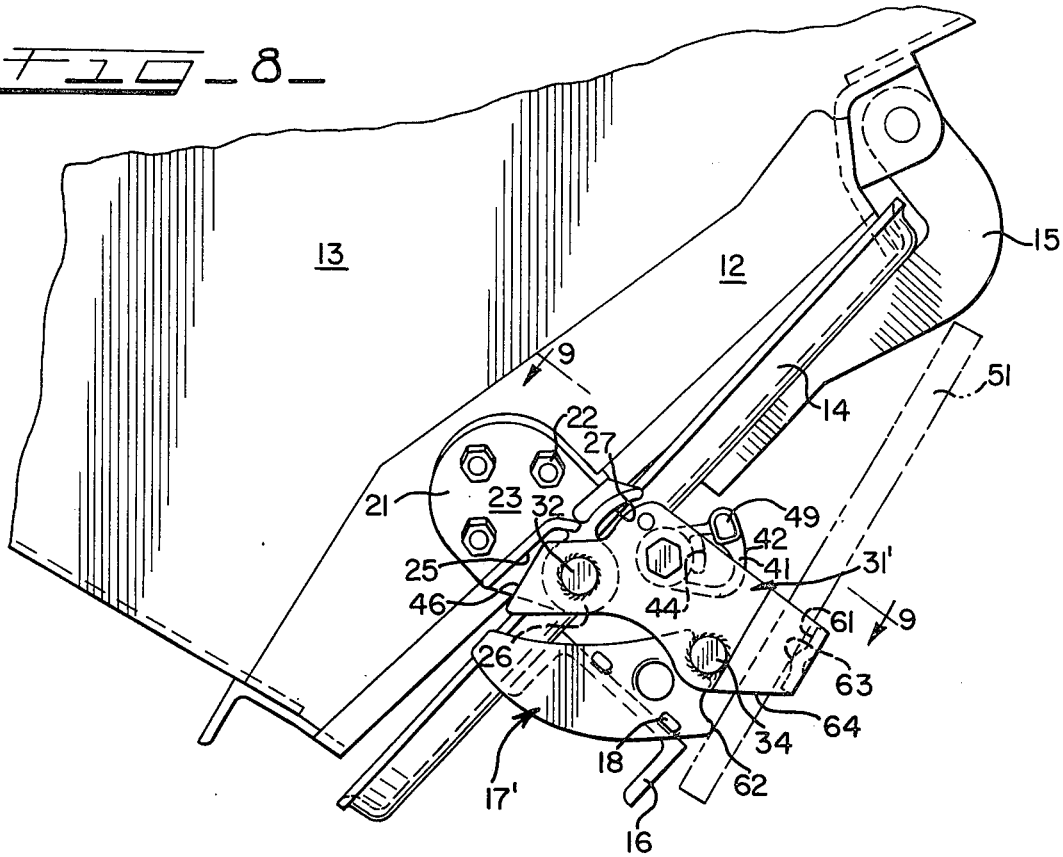
FIG. 8 is a side elevational view of an alternative embodiment of the levered lock mechanism of this invention, shown mounted on an outside hopper door frame of a railway hopper car with a lever bar in position to move the door from its catch position to its fully closed position.
Figure 9:
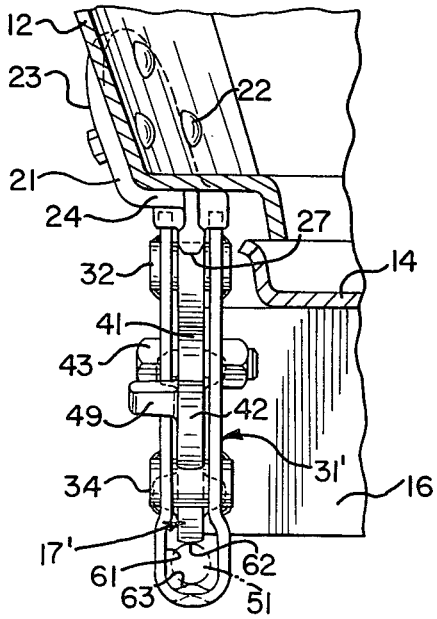
FIG. 9 is a detail sectional view taken on line 9—9 of FIG. 8.
Figure 10:
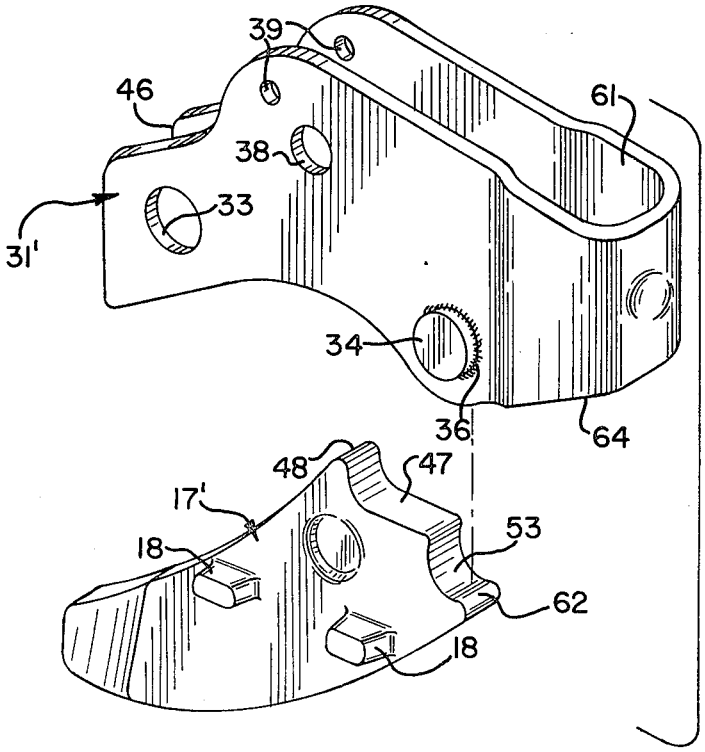
FIG. 10 is an exploded perspective view of the keeper assembly and the hook assembly of the alternative embodiment shown in FIG. 8.

In the alternative embodiment of FIGS. 8, 9, and 10, the fulcrum means for pry bar action includes a hook assembly 31' having a lever-receiving passageway 61 therethrough in cooperation with lower corner 62 of a keeper assembly 17'. A structure such as the keeper rod 52 of keeper assembly 17 in the FIGS. 1–7 embodiment is not required for keeper assembly 17'. Basically, the operation of the embodiment shown in FIGS. 8–10 is the same as that of the embodiment shown in FIGS. 1–7, with the door 14 moving from the fully opened position to the catch position and then being levered to the fully closed position, except that the lever bar 51 is inserted into passageway 61 rather than between lever rod 35 and keeper rod 52 of FIGS. 1–7. In order to provide an especially advantageous fulcrum point for the lever bar 51, an indent 63 is located within passageway 61 in this embodiment for engagement with the lever bar 51.

With reference to the preferred embodiment illustrated in FIGS. 11 through 15, this embodiment has structural features generally corresponding to the other embodiments, and it operates in substantially the same manner. It does have at least one additional advantageous feature in that a long pry or lever bar 51 can open and close the lock mechanism without any interference from an overhanging ledge 119 of the hopper because the bar 51 can be operated with its remote or hand-held end spaced away from the hopper to an extent that the bar 51 will easily clear the ledge 119.

Lock mechanism 111 includes a housing assembly 121 secured to the door frame 12 by means of rivets 122, nuts and bolts, or the like. An internal shelf or step ledge 125 is located within the housing assembly 121 to act as a stop for generally downward, or clockwise rotation of a hook assembly 131. Housing assembly 121 is bifurcated into an outer housing member 154 and an inner housing member 155, each having a locking latch pivot hole 138 (FIG. 15) and a pair of opposing bolt holes 139.

Hook assembly 131 is pivotally mounted to housing 121 by means of a pivot rod or, preferably and to avoid a welding step, a trunion 132 passing through each of two apertures 126 in the bifuricated housing 121. The outer housing member 154 and the inner housing member 155 are secured together by the rivets 122 and the hook assembly 131 pivots between housing members 154, 155. Hook assembly lever rod 135 protrudes generally laterally from the outside surface of the hook assembly 131.

Pivotally mounted to housing assembly 121 through the locking latch pivot holes 138 is a locking latch 141 having a curved abutment face 142 for contacting a generally complimentary abutment edge 127 of the hook assembly 131 when the door 14 is in its fully closed position. Locking latch 141 is mounted to housing assembly 121 by means of a pivot member which can be a rod, a rivet, a nut and bolt, or, preferably, a trunion 143. A curved slot 144 is located within the locking latch 141 in general alignment with the bolt holes 139 so that a nut and bolt assembly 145 can be passed therethrough to lock the mechanism 111 and hence the door 14 in a semi-permanent manner if desired, such as when the hopper car is to be turned upside down. Locking latch 141 has a lug 149 for driving and rotating the latch 141.

When door 14 is in its fully open position as shown in FIG. 11, the hook assembly 131 is completely disengaged from a keeper assembly 117 mounted on the spreader bar 16 of the door 14 by bolts or rivets 118 in association with a keeper adjustment hold-down clamp 129. Also, one end 146 of the hook assembly 131 generally abuts against the internal stop ledge 125 of the housing assembly 121, such abutting contact defining the limit of clockwise rotation or pivoting of the hook assembly 131. Generally, when not in locking engagement, the locking latch will rest as its counterclockwise rotation limit, the lug 149 being against a ledge 156 within the outer housing member of the housing assembly 121.

The catch position of the lock mechanism 111 is illustrated in FIG. 12, at which position an extension 134 of the keeper assembly 117 rests within a first or catch notch or saddle formation 147 of said hook assembly 131. In moving the door 14 from the fully open position shown in FIG. 11 to the catch position shown in FIG. 12, a workman on each side of the hopper car pushes the door 14 toward its closed position until the keeper assembly extension 134 initially engages the slope upper corner 133 and then a lower corner 148 of the hook assembly 131. By continuing to push the door 14, the hook assembly 131 will move counterclockwise until the extension 134 clears the lower corner 148, at which time the hook assembly 131 will pivot clockwise as the hook assembly 131 falls until the extension 134 rests within the first saddle formation 147 to operatively engage the hook assembly 131 with the keeper assembly 117 and locate the door 14 in its catch position. A kicker 123 extends from hook assembly 131 for receiving a blow from the keeper assembly 117 to rotate the hook assembly 131 clockwise in the event it becomes hung up in the housing assembly 121.

Once the lock mechanism 111 is in the catch position, the workman may proceed to fully close the door 14, which step is depicted in FIG. 12. A pry bar or lever bar 51 is inserted into the fulcrum means of this lock mechanism 111, which means is a combination of the lever rod 135 of the hook assembly 131 and the inner surfaces 152 of the keeper assembly extention 134, which surfaces 152 may include a generally transversely projecting ear 157. This fulcrum means is especially advantageous because it provides a firm hold upon the lever bar 51 generally along its entire circumference to prevent bar 51 from slipping out when in use.

Next, the workman pushes on the lever bar 51 or pulls it toward him in a generally clockwise direction to thereby exert a levered or prying force directly on keeper assembly 117 and rod 135. As a first stage of closing, the door 14 is moved to its closed position as the keeper assembly extension 134 passes from the first saddle formation 147 and into a second or closed notch or saddle formation 153. Then, in a second stage of closing, the lever bar 51 exerts a generally downward force upon lever rod 135 to move the hook assembly 131 down until the keeper assembly extension 134 is pushed fully into the second saddle formation 153, at which time the lock mechanism 111 will be in its fully closed position, illustrated in FIGS. 13 and 14. The workman may then rotate the locking latch 141 in a clockwise direction until the curved abutment face 142 thereof firmly engages the abutment edge 127. At this location, the bolt holes 139 of the housing assembly 121 are in general alignment with a curved slot 144 of the locking latch 141 so the nut and bolt assembly 145 may be passed therethrough and tightened to semi-permanently lock the mechanism 111.

Figure 15:
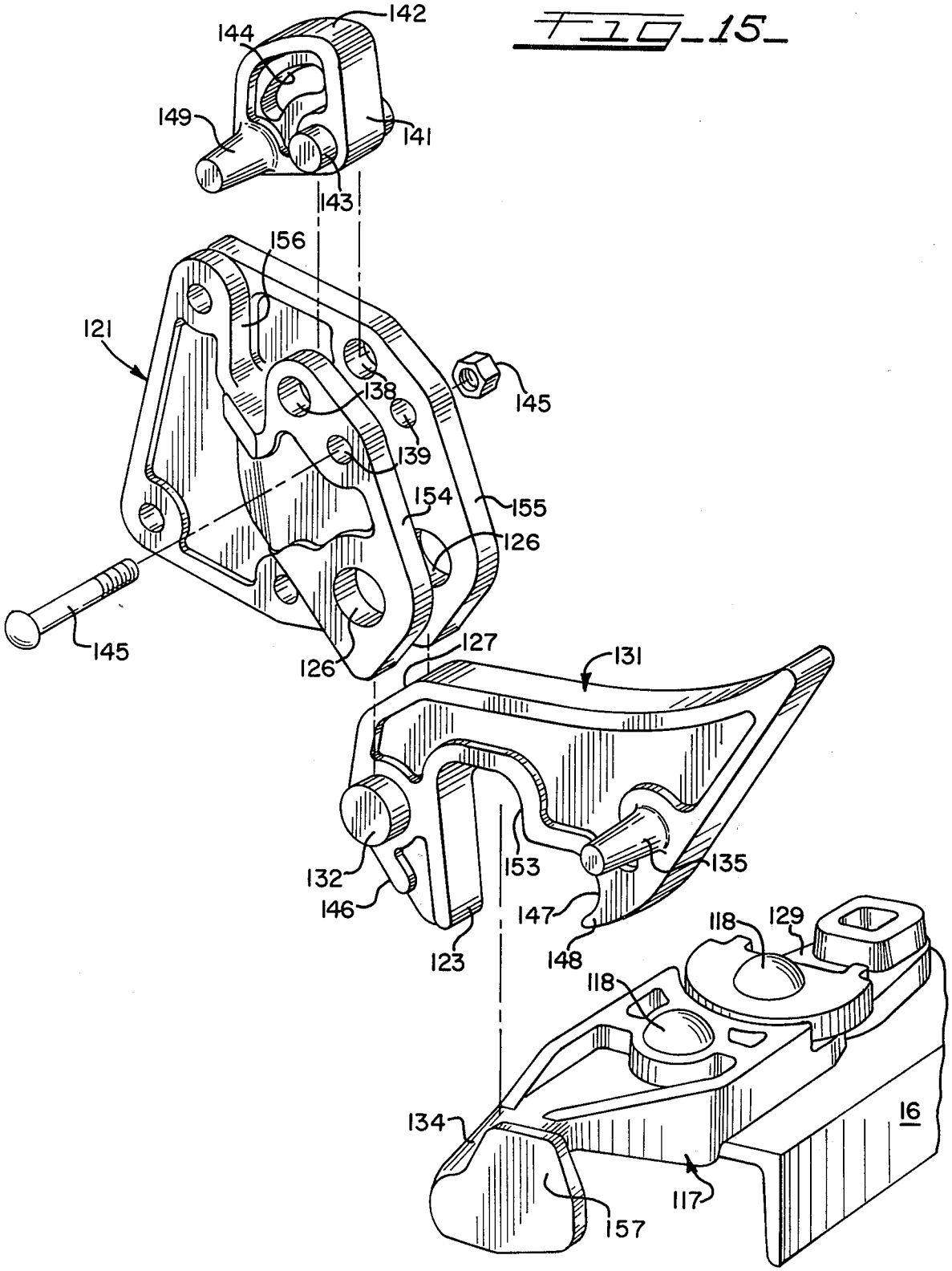
FIG. 15 is an exploded perspective view of the embodiment of the lock mechanism which is illustrated in FIG. 11 through FIG. 14, showing the housing, the hook assembly, the keeper assembly, the locking latch, and their general operative relationships to each other.

FIG. 15 most clearly shows the structural features of the various assembly parts of the preferred embodiment, including the keeper assembly 117 and its extension 134 inner surfaces 152, the housing assembly 121, the hook assembly 131 with its lever rod 135 and trunion 132, the locking latch 141 with its trunion 143, and the nut and bolt assembly 145.

When the doors of a loaded hopper car having locking mechanism 11 or 111 are to be opened in order to have the contents thereof flow out of the underside of the railway car, the workman rotates the locking latch 41 or 141 out of its locking position engagement. In the embodiment of FIGS. 1–7, he then applies an upward force, which can be a levered force from a pry or lever bar, to the lever rod 35 of the hook assembly 31 which raises the hook assembly 31 and disengages the locking rod 34 from the second or closed saddle formation 53 whereby the hook assembly 31 clears the keeper assembly 17, and the door 14 falls to the fully opened position. In the embodiment of FIGS. 8–10, the upward force is applied to bottom edge 64 of the hook assembly 61, with the same result. In the embodiment of FIGS. 11–15, the upward force is applied to the lever rod 135 of the hook assembly 131 which raises the hook assembly 131 and disengages keeper assembly 117 from the second or closed saddle formation 153 whereby the hook assembly 131 clears the keeper assembly 117, and the door 14 falls to the fully opened position.

It will be apparent to those skilled in this art that the present invention can be embodied in various forms of levered lock mechanisms and various arrangements thereof in conjunction with hopper doors and the like. Accordingly, this invention is to be construed and limited only by the scope of the appended claims.

We claim:

1. A lever operated lock mechanism for a railway hopper car comprising: a housing assembly for mounting to a slope sheet of a railway hopper car; a hook assembly pivotally mounted onto said housing; a pivotally mounted locking latch; a keeper assembly for rigid mounting on a hopper door; said hook assembly and said keeper assembly having means for operative interengagement with each other; said interengagement means including a first saddle formation, a second saddle formation, and a member for operatively engaging and resting within one of each of said saddle formations at a lock mechanism catch position and at a lock mechanism closed position; a fulcrum means on said hook assembly and said keeper assembly for receiving a lever bar to lever said engaging member from catch position latching engagement with said first saddle formation to closed position latching engagement with said second saddle formation; an abutment edge for engagement with said locking latch to lock the mechanism in said closed position; said engaging member is a rigid extension of said keeper assembly, said first saddle formation is a bottom notch on said hook assembly, and said second saddle formation is a bottom notch on said hook assembly that is deeper than said first saddle formation.

2. The lever operated lock mechanism of claim 1, wherein said fulcrum means operates with two stages of closing, the first stage closing the hopper door and the second stage for moving said hook assembly downwardly to fully engage said second saddle formation and said engaging member.

3. The lever operated lock mechanism of claim 1, wherein said abutment edge for engagement with said locking latch is on said hook assembly, and said hook assembly includes a kicker for receiving a blow to rotate the hook assembly.

4. The lever operated lock mechanism of claim 1, wherein said means for operative engagement with each other includes a corner for deflecting said hook assembly upwardly before it operatively engages said first saddle formation when the hopper door moves from a fully opened position to a catch position.

5. A lever operated lock mechanism for a railway hopper car comprising: a housing assembly for mounting to a slope sheet of a railway hopper car; a hook assembly pivotally mounted onto said housing; a pivotally mounted locking latch; a keeper assembly for rigid mounting on a hopper door; said hook assembly and said keeper assembly having means for operative interengagement with each other; said interengagement means including a first saddle formation, a second saddle formation, and a member for operatively engaging and resting within one of each of said saddle formations at a lock mechanism catch position and at a lock mechanism closed position; a fulcrum means on said hook assembly and said keeper assembly for receiving a lever bar to lever said engaging member from catch position latching engagement with said first saddle formation to closed position latching engagement with said second saddle formation; an abutment edge for engagement with said locking latch to lock the mechanism in said closed position; said engaging member is a locking rod of said hook assembly, said first saddle formation is an upwardly facing notch on said keeper assembly, and said second saddle formation is an upwardly facing notch on said keeper assembly.

6. The lever operated lock mechanism of claim 5, wherein said engaging member is a locking rod, and said hook assembly is a bifurcated member joined by said locking rod.

7. The lever operated lock mechanism of claim 5, wherein said abutment edge for engagement with said locking latch is on said housing assembly above an apertured lug of said housing assembly for mounting said hook assembly.

8. A lever operated lock mechanism for a railway hopper car comprising: a housing assembly for mounting to a slope sheet of a railway hopper car; a hook assembly pivotally mounted onto said housing; a pivotally mounted locking latch; a keeper assembly for rigid mounting on a hopper door; said hook assembly and said keeper assembly having means for operative interengagement with each other; said interengagement means including a first saddle formation, a second saddle formation, and a member for operatively engaging and resting within one of each of said saddle formations at a lock mechanism catch position and at a lock mechanism closed position; a fulcrum means on said hook assembly and said keeper assembly for receiving a lever bar to lever said engaging member from catch position latching engagement with said first saddle formation to closed position latching engagement with said second saddle formation; an abutment edge for engagement with said locking latch to lock the mechanism in said closed position; said housing assembly has a lateral portion and a generally transverse portion to overlie a corner of a slope sheet of a hopper, a stop ledge for limiting generally downward rotation of said hook assembly is located on said transverse portion, and an apertured lug protrudes from said transverse portion for receiving a pivot rod to mount said hook assembly thereon.

9. A lever operated lock mechanism for a railway hopper car comprising: a housing assembly for mounting to a slope sheet of a railway hopper car; a hook assembly pivotally mounted onto said housing; a pivotally mounted locking latch; a keeper assembly for rigid mounting on a hopper door; said hook assembly and said keeper assembly having means for operative interengagement with each other; said interengagement means including a first saddle formation, a second saddle formation, and a member for operatively engaging and resting within one of each of said saddle formations at a lock mechanism catch position and at a lock mechanism closed position; a fulcrum means on said hook assembly and said keeper assembly for receiving a lever bar to lever said engaging member from catch position latching engagement with said first saddle formation to closed position latching engagement with said second saddle formation; an abutment edge for engagement with said locking latch to lock the mechanism in said closed position; said housing assembly is bifurcated into an outer housing member and and an inner housing member, a stop ledge for limiting generally downward rotation of said hook assembly is located between said bifurcated housing members, and said hook assembly includes a trunion for mounting it onto said bifurcated housing members.

10. A lever operated lock mechanism for a railway hopper car comprising: a housing assembly for mounting to a slope sheet of a railway hopper car; a hook assembly pivotally mounted onto said housing; a pivotally mounted locking latch; a keeper assembly for rigid mounting on a hopper door; said hook assembly and said keeper assembly having means for operative interengagement with each other; said interengagement means including a first saddle formation, a second saddle formation, and a member for operatively engaging and resting within one of each of said saddle formations at a lock mechanism catch position and at a lock mechanism closed position; a fulcrum means on said hook assembly and said keeper assembly for receiving a lever bar to lever said engaging member from catch position latching engagement with said first saddle formation to closed position latching engagement with said second saddle formation; an abutment edge for engagement with said locking latch to lock the mechanism in said closed position; and said locking latch includes a curved slot and a pair of opposing bolt holes are positioned for alignment with said curved slot to permit a nut and bolt assembly to be passed throught said curved slot and pair of bolt holes for semi-permanently locking said lever operated lock mechanism.

11. A lever operated lock mechanism for a railway hopper car comprising: a housing assembly for mounting to a slope sheet of a railway hopper car; a hook assembly pivotally mounted onto said housing; a pivotally mounted locking latch; a keeper assembly for rigid mounting on a hopper door; said hook assembly and said keeper assembly having means for operative interengagement with each other; said interengagement means including a first saddle formation, a second saddle formation, and a member for operatively engaging and resting within one of each of said saddle formations at a lock mechanism catch position and at a lock mechanism closed position; a fulcrum means on said hook assembly and said keeper assembly for receiving a lever bar to lever said engaging member from catch position latching engagement with said first saddle formation to closed position latching engagement with said second saddle formation; an abutment edge for engagement with said locking latch to lock the mechanism in said closed position; and said fulcrum means includes a lever rod projecting from said hook assembly and inner surfaces of an extension of said keeper assembly to provide a passageway for the lever bar that holds the lever bar firmly when in use.

12. A lever operated lock mechanism for a railway hopper car comprising: a housing assembly for mounting to a slope sheet of a railway hopper car; a hook assembly pivotally mounted onto said housing; a pivotally mounted locking latch; a keeper assembly for rigid mounting on a hopper door; said hook assembly and said keeper assembly having means for operative interengagement with each other; said interengagement means including a first saddle formation, a second saddle formation, and a member for operatively engaging and resting within one of each of said saddle formations at a lock mechanism catch position and at a lock mechanism closed position; a fulcrum means on said hook assembly and said keeper assembly for receiving a lever bar to lever said engaging member from catch position latching engagement with said first saddle formation to closed position latching engagement with said locking latch to lock the mechanism in said closed position; and said fulcrum means includes a lever rod projecting from said hook assembly and a keeper rod projecting from said keeper assembly.

13. A lever operated lock mechanism for a railway hopper car comprising: a housing assembly for mounting to a slope sheet of a railway hopper car; a hook assembly pivotally mounted onto said housing; a pivotally mounted locking latch; a keeper assembly for rigid mounting on a hopper door; said hook assembly and said keeper assembly having means for operative interengagement with each other; said interengagement means including a first saddle formation, a second saddle formation, and a member for operatively engaging and resting within one of each of said saddle formations at a lock mechanism catch position and at a lock mechanism closed position; a fulcrum means on said hook assembly and said keeper assembly for receiving a lever bar to lever said engaging member from catch position latching engagement with said first saddle formation to closed position latching engagement with said second saddle formation; an abutment edge for engagement with said locking latch to lock the mechanism in said closed position; and said fulcrum means includes a lever-receiving passageway through the hook assembly and a lower corner below said bottom saddle formation of said keeper assembly.

14. The lever operated lock mechanism of claim 13, wherein said lever-receiving passageway includes a lever-engaging indent therewithin.

15. In combination with a multiple door railway car hopper chute of the type wherein the multiple doors are joined by a spreader bar, a hopper door lock mechanism having a hook assembly, a pivotable locking latch, and a keeper assembly mounted on said spreader bar for operative interengagement with said hook assembly, said hook assembly being pivotally mounted to a housing assembly that is secured onto a slope sheet of the hopper chute, said hook assembly and said keeper assembly having means for operative interengagement with each other, the improvement which comprises: said interengagement means including a first saddle formation, a second saddle formation, and a member for operatively engaging and resting either within said first saddle formation at a lock mechanism catch position or within said second saddle formation at a lock mechanism closed position; a fulcrum means on said hook assembly and said keeper assembly for receiving a lever bar to lever said engaging member from said first saddle formation to said second saddle formation for moving the multiple doors from a catch position to a fully closed position; and said fulcrum means includes a lever rod projecting from said hook assembly and inner surfaces of an extension of said keeper assembly.

16. In combination with a multiple door railway car hopper chute of the type wherein the multiple doors are joined by a spreader bar, a hopper door lock mechanism having a hook assembly, a pivotable locking latch, and a keeper assembly mounted on said spreader bar for operative interengagement with said hook assembly, said hook assembly being pivotally mounted to a housing assembly that is secured onto a slope sheet of the hopper chute, said hook assembly and said keeper assembly having means for operative interengagement with each other, the improvement which comprises: said interengagement means including a first saddle formation, a second saddle formation, and a member for operatively engaging and resting either within said first saddle formation at a lock mechanism catch position or within said second saddle formation at a lock mechanism closed position; a fulcrum means on said hook assembly and said keeper assembly for receiving a lever bar to lever said engaging member from said first saddle formation to said second saddle formation for moving the multiple doors from a catch position to a fully closed position; and said fulcrum means includes a lever rod projecting from said hook assembly and a keeper rod projecting from said keeper assembly.

17. In combination with a multiple door railway car hopper chute of the type wherein the multiple doors are joined by a spreader bar, a hopper door lock mechanism having a hook assembly, a pivotable locking latch, and a keeper assembly mounted on said spreader bar for operative interengagement with said hook assembly, said hook assembly being pivotally mounted to a housing assembly that is secured onto a slope sheet of the hopper chute, said hook assembly and said keeper assembly having means for operative interengagement with each other, the improvement which comprises: said interengagement means including a first saddle formation, a second saddle formation, and a member for operatively engaging and resting either within said first saddle formation at a lock mechanism catch position or within said second saddle formation at a lock mechanism closed position; a fulcrum means on said hook assembly and said keeper assembly for receiving a lever bar to lever said engaging member from said first saddle formation to said second saddle formation for moving the multiple doors from a catch position to a fully closed position; and said fulcrum means includes a lever-receiving passageway through the hook assembly and a lower corner below said bottom saddle formation of said keeper assembly.

18. The combination of claim 19, wherein said lever-receiving passageway includes a lever-engaging indent therewithin.

19. In combination with a multiple door railway car hopper chute of the type wherein the multiple doors are joined by a spreader bar, a hopper door lock mechanism having a hook assembly, a pivotable locking latch, and a keeper assembly mounted on said spreader bar for operative interengagement with said hook assembly, said hook assembly being pivotally mounted to a housing assembly that is secured onto a slope sheet of the hopper chute, said hook assembly and said keeper assembly having means for operative interengagement with each other, the improvement which comprises: said interengagement means including a first saddle formation, a second saddle formation, and a member for operatively engaging and resting either within said first saddle formation at a lock mechanism catch position or within said second saddle formation at a lock mechanism closed position; a fulcrum means on said hook assembly and said keeper assembly for receiving a lever bar to lever said engaging member from said first saddle formation to said second saddle formation for moving the multiple doors from a catch position to a fully closed position; and said locking latch includes a curved slot and a pair of opposing bolt holes are positioned for alignment with said curved slot to permit a nut and bolt assembly to be passed through said curved slot and pair of bolt holes for semi-permanently locking said hopper door lock mechanism.

20. A lever operated lock mechanism for a door to a hopper outlet, which door is hinged from above the outlet, comprising: a housing assembly mountable onto an outside slope sheet of a hopper; a hook assembly pivotally mounted to said housing assembly; said housing assembly being bifurcated into an outer housing member and an inner housing member, said housing assembly including a stop ledge for limiting generally downward rotation of said hook assembly; said hook assembly being mounted by a trunion to said bifurcated housing members; said hook assembly having a first saddle formation in its bottom edge; said hook assembly having a second saddle formation in its bottom edge and deeper than said first saddle formation; a keeper assembly having an extension operatively engageable with said saddle formations of the hook assembly; a locking latch pivotally mounted to the housing assembly for abutting said hook assembly; said hook assembly having a protruding lever rod; and said lever rod and said extension of the keeper assembly being structured with respect to each other for receiving a lever bar to lever said keeper assembly extension between said top saddle formation and said bottom saddle formation while a remote end of the lever bar is spaced away from the slope sheet of the hopper and is clear of obstructions.

* * * * *

UNITED STATES PATENT AND TRADEMARK OFFICE

CERTIFICATE OF CORRECTION

PATENT NO. : 4,252,066

DATED : February 24, 1981

INVENTOR(S) : Franklin P. Adler et al

It is certified that error appears in the above-identified patent and that said Letters Patent are hereby corrected as shown below:

Under "References Cited", the third reference should be "Adler" not --Allen--.

Column 6, line 54, "extention" should read --extension--.

Column 9, line 34, delete the second "and".

Column 9, line 62, "throught" should read --through--.

Signed and Sealed this

*Ninth* Day of *June 1981*

[SEAL]

*Attest:*

RENE D. TEGTMEYER

*Attesting Officer*

*Acting Commissioner of Patents and Trademarks*